United States Patent [19]

Swartzbaugh et al.

[11] 4,399,920

[45] Aug. 23, 1983

[54] CHILD RESISTANT PACKAGE

[75] Inventors: Peter T. Swartzbaugh, Toledo; Paul W. Harbauer, Perrysburg, both of Ohio

[73] Assignee: Owens-Illinois, Inc., Toledo, Ohio

[21] Appl. No.: 356,996

[22] Filed: Mar. 11, 1982

[51] Int. Cl.[3] ..... B65D 55/02

[52] U.S. Cl. ..... 215/211; 215/222

[58] Field of Search ..... 215/211, 222, 330, 332; 220/293, 295, 297

[56] References Cited

U.S. PATENT DOCUMENTS

| | | | |
|---|---|---|---|
| 3,888,383 | 6/1975 | Rowlands | 220/293 |
| 4,057,159 | 11/1977 | Fillmore et al. | 215/222 |
| 4,059,198 | 11/1977 | Mumford | 215/211 |
| 4,275,817 | 6/1981 | Patton | 215/222 |

*Primary Examiner*—George T. Hall

*Attorney, Agent, or Firm*—John R. Nelson; Myron E. Click

[57] ABSTRACT

A child resistant package comprising an open-mouth plastic container and a closure. The container has a plurality of circumferentially spaced projections extending radially outwardly adjacent the open end thereof, each projection having a shoulder facing downwardly in one circumferential direction. A closure has a top panel and an annular skirt depending from the periphery of the top panel and a plurality of radially inwardly extending and circumferentially spaced locking lugs on the inner surface of the skirt. The locking lugs are adapted to engage the shoulders in the projections on the container. The closure has a liner sealingly engaging the open end of the container and extending downwardly into sealing engagement with the inner surface of the upper open end of the container. The closure has at least one cam lug positioned on the inner surface of the skirt such that it is positioned between projections when the closure is on the container and the locking lugs are in engagement with the projections. The cam lug has an inclined surface operable when an axial force is applied to the closure and the closure is rotated in a direction to disengage the locking lugs from the projections so that continued rotation of the closure will cam the closure axially upwardly disengaging the closure from the container.

8 Claims, 10 Drawing Figures

CHILD RESISTANT PACKAGE

This invention relates to child resistant packages and particularly to a combined child resistant closure and container.

BACKGROUND AND SUMMARY OF THE INVENTION

It has been recognized that packages for medicinal and other materials should preferably be resistant for removal by children. In one child resistant package shown in U.S. Pat. No. 4,059,198, the package comprises a cylindrical plastic body which has circumferentially spaced radially extending projections on the upper end thereof which have downwardly facing notches therein. The closure associated with the container comprises a one-piece plastic body having a top panel and a depending annular skirt with circumferentially spaced lugs extending radially inwardly for engagement with the notches. The closure includes a one-piece liner comprising a disc member which engages the upper rim of the container and includes a downwardly depending plug member which provides a vapor-tight seal with the inside surface of the container. The liner also serves as a spring between the closure and the container to bias the closure lugs into engagement with the projections on the container.

In some circumstances, it has been found that such a closure may be difficult to remove from the container even though released from locking position because of the tendency of the plug portion of the liner to resist removal of the closure.

Accordingly, among the objectives of the present invention are to provide a child resistant package of the type wherein sealing engagement is provided with the inner surface of the container and the closure can be more readily removed; which feature of ready removability is achieved in a simple and inexpensive manner.

In accordance with the invention, the child resistant package comprises an open-mouth plastic container and a closure. The closure has a plurality of circumferentially spaced projections extending radially outwardly adjacent the open end thereof, each projection having a shoulder facing downwardly in one circumferential direction. A closure has a top panel and an annular skirt depending from the periphery of the top panel and a plurality of radially inwardly extending and circumferentially spaced locking lugs on the inner surface of the skirt. The locking lugs are adapted to engage the shoulders in the projections on the container. The closure has a liner sealingly engaging the open end of the container and extending downwardly into sealing engagement with the inner surface of the upper open end of the container. The closure has at least one cam lug positioned on the inner surface of said skirt such that it is positioned between projections when the closure is on the container and the locking lugs are in engagement with the projections. The cam lug has an inclined surface operable when an axial force is applied to the closure and the closure is rotated in a direction to disengage the locking lugs from the projections so that continued rotation of the closure will cam the closure axially upwardly disengaging the closure from the container.

DESCRIPTION

Figure 1:
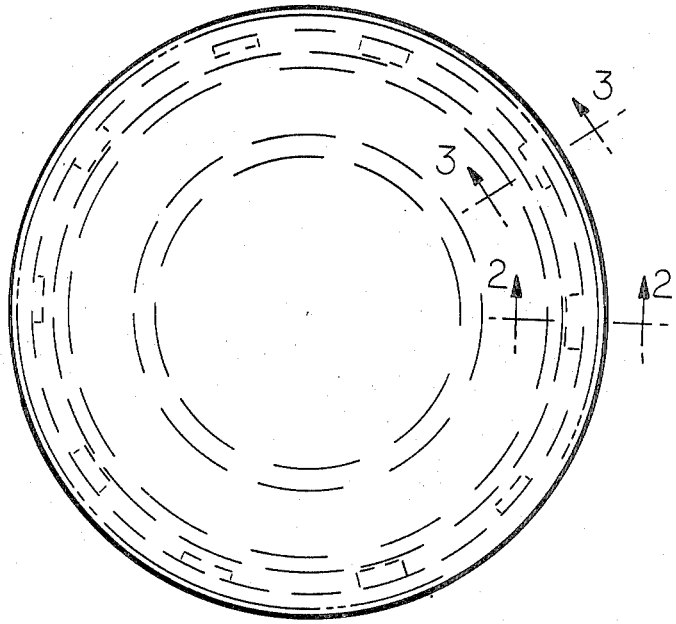
FIG. 1 is a plan view of a child resistant package embodying the invention.

Referring to FIGS. 1–7, the child resistant package comprising the invention includes a container 20 and a closure 21. The container 20 is shown as being cylindrical and having a side wall 22 and bottom wall 23 with an open upper end defining a rim 24. The container 20 is provided with a plurality of circumferentially spaced, radially extending projections 25 formed on the upper end of the outer surface of the wall 22. The projections 25 include tapered cam surfaces 26 and radial and axial surfaces 27, 28 defining a shoulder that faces downwardly and in one circumferential direction toward the left as viewed in FIG. 5.

Figure 2:
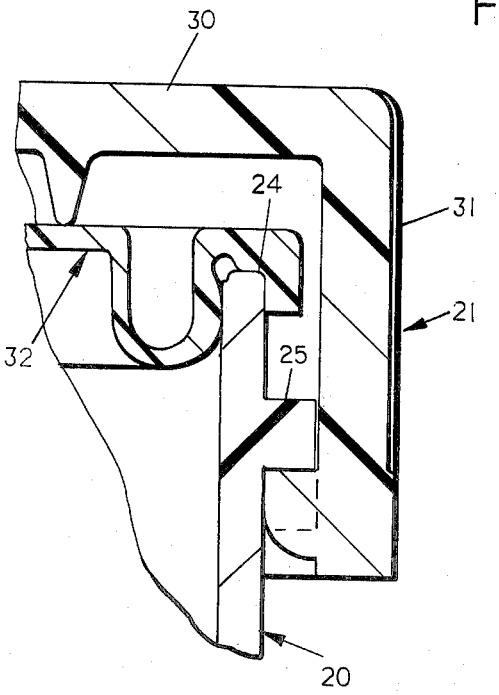
FIG. 2 is a fragmentary sectional view on an enlarged scale taken along the line 2—2 in FIG. 1.
Figure 3:
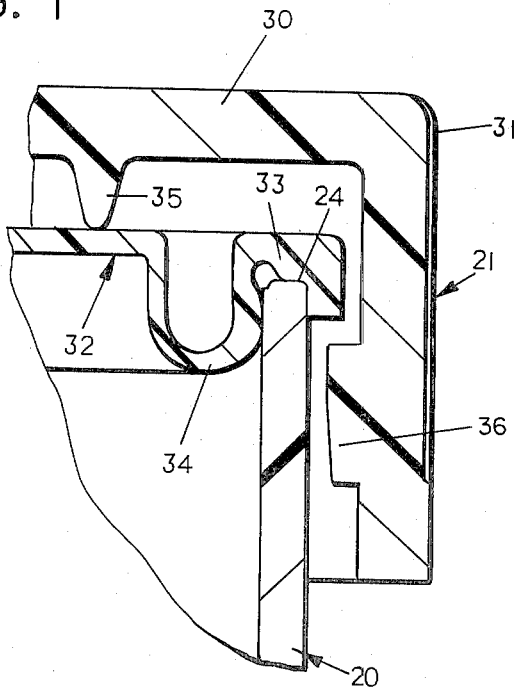
FIG. 3 is a fragmentary sectional view on an enlarged scale taken along the line 3—3 in FIG. 1.
Figure 4:
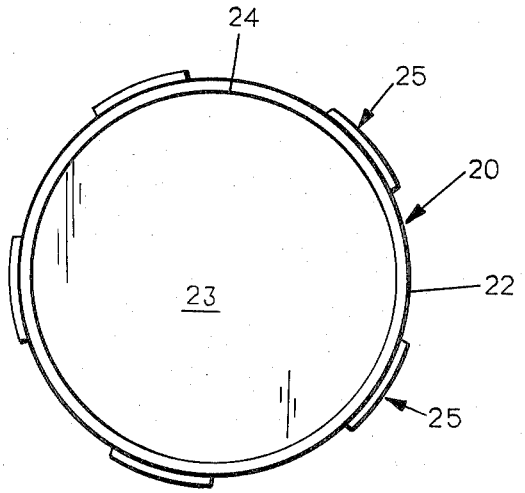
FIG. 4 is a plan view of the container that forms part of the child resistant package.
Figure 5:
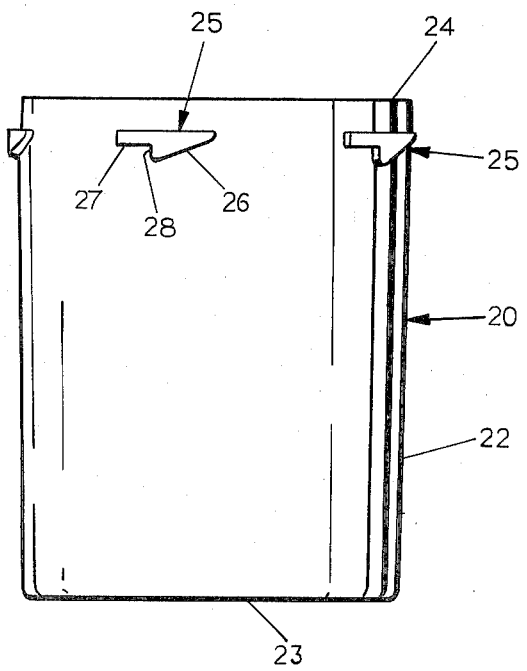
FIG. 5 is an elevational view of the same.
Figure 6:
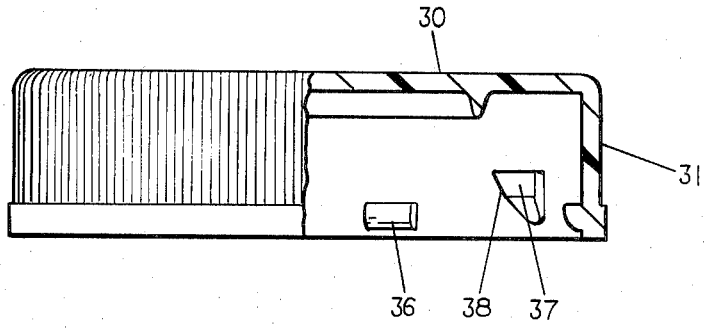
FIG. 6 is a part sectional elevational view of the closure.
Figure 7:
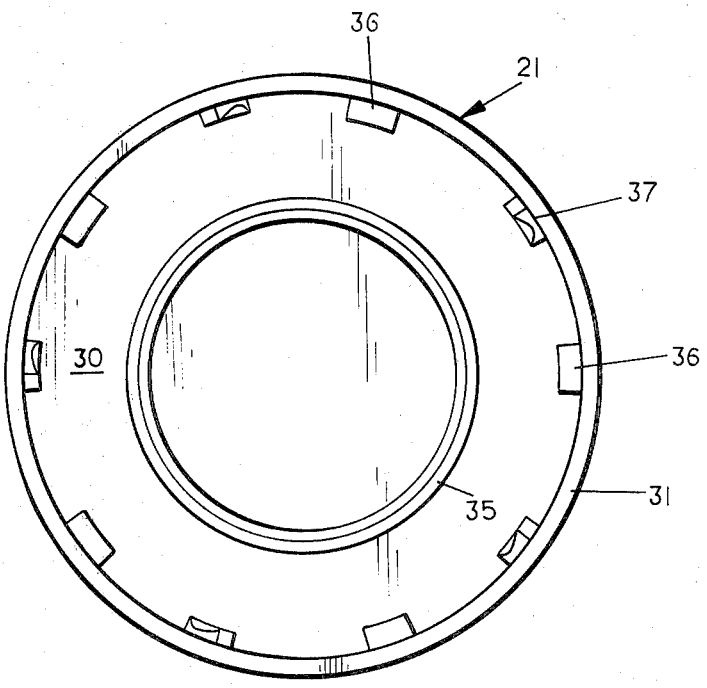
FIG. 7 is a bottom plan view of the closure.

Referring to FIGS. 6 and 7, the closure 21 includes a top panel 30 and an annular peripheral wall or skirt 31. As shown in FIG. 2, a liner or fitment 32 is provided and includes a sealing portion 33 engaging the rim 24. The fitment also includes a downwardly extending plug portion 34 that engages the inner surface of the wall 21 of the container when the closure is on the container, as shown in FIGS. 2 and 3 to define a vapor-tight seal.

Plug portion 34 also provides a spring urging the central portion of fitment 32 against an annular rib 35. The fitment 32 is more fully described in U.S. Pat. No. 4,059,198 which is incorporated herein by reference.

The closure 21 is also formed with a plurality of inwardly extending rectangular locking lugs 36 circumferentially spaced about the inner surface of the wall 31 and adapted to engage the shoulders on the projections 25 on the container as presently described. A plurality of cam lugs 37 are also provided about the inner surface of the skirt 31 in circumferentially spaced relation and are generally triangular in vertical section. Each cam lug 37 includes a cam surface 38 that is inclined to the vertical at an angle of preferably 52°.

The container and closure are preferably made of organic plastic material.

Figure 8:
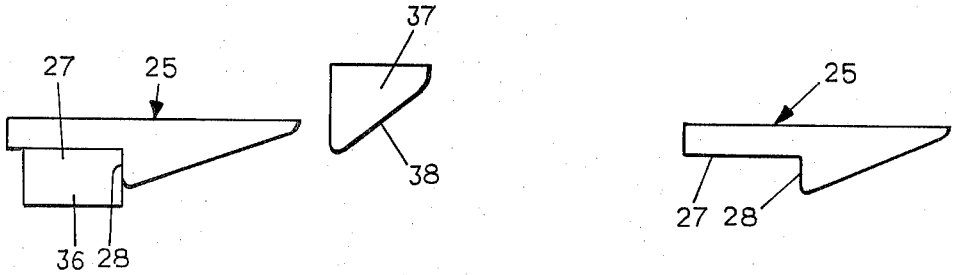
FIGS. 8, 9 and 10 are partly diagrammatic views showing the relationship between the parts of the closure and container in various operating positions.

In order to engage the closure 21 with the container 20, the closure 21 is brought into position adjacent the upper end of the container so that the locking lugs 36 are between the projections 25. The closure 21 is then rotated so that the locking lugs 36 slide along the inclined or camming surfaces 26 of the projections 25 until the locking lugs 36 engage the shoulders, as shown diagrammatically in FIG. 8.

Figure 9:
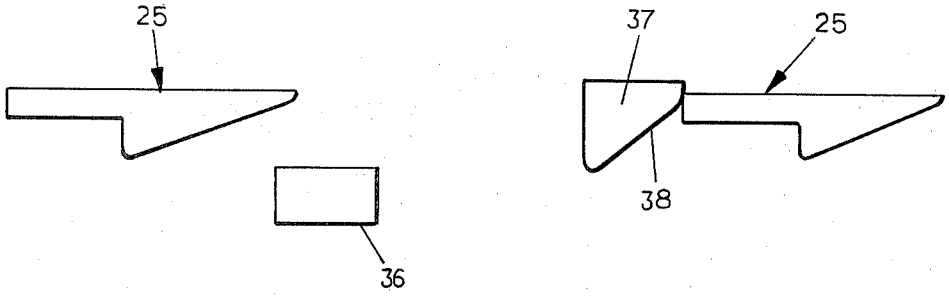
Figure 10:
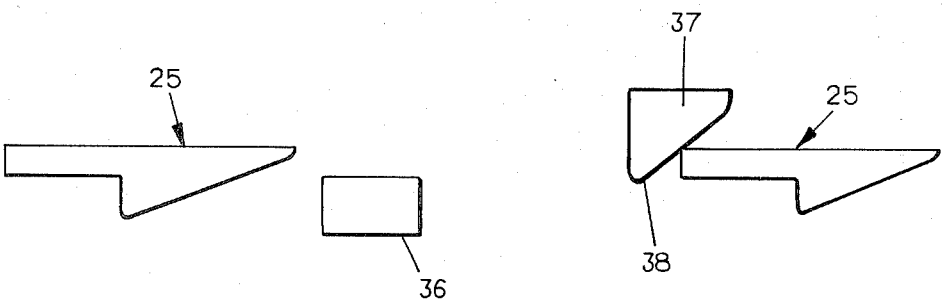

In order to remove the closure 21 from the container 20, an axial downward force is applied to the closure 21 against the spring action and the closure 21 is rotated in the opposite direction to disengage the locking lugs 36 from the projections 25. As the closure 21 is rotated, the cam lugs 37 are caused to engage the projections 25 (FIG. 9) so that the inclined surfaces 38 of the cam lugs 37 engage the projections and cam the closure 21 (FIG. 10) axially upwardly with respect to the container 20 resulting in its complete disengagement.

It can thus be seen that there has been provided a child resistant package which is vapor resistant and yet can be readily removed when properly manipulated without undesirable interference by the vapor resistant seal.

We claim:

1. A child resistant package comprising an open-mouth container having a plurality of circumferentially spaced projections extending radially outwardly adjacent the open end thereof, each said projection having a shoulder facing downwardly in one circumferential direction, a closure having a top panel and an annular skirt depending from the periphery of the top panel, a plurality of radially inwardly extending and circumferentially spaced locking lugs on the inner surface of said skirt, said locking lugs being adapted to engage the shoulders in the projections on the container, said closure having means for sealingly engaging the open end of the container and extending downwardly into sealing engagement with the inner surface of the upper open end of the container, said closure having at least one cam lug positioned on the inner surface of said skirt such that it is positioned between projections when the closure is on the container and the locking lugs are in engagement with said projections, said cam lug having an inclined surface operable by engagement with a projection when an axial force is applied to the closure and the closure is rotated in a direction to disengage the locking lugs from the shoulders to engage a projection so that continued rotation of the closure will cam the closure axially upwardly disengaging the closure from the container.

2. The child resistant package set forth in claim 1 including a plurality of circumferentially spaced cam lugs.

3. The child resistant package set forth in claim 2 wherein each said cam lug is generally triangular in vertical section.

4. The child resistant package set forth in claim 3 wherein said inclined surface of each said lug is at an angle of approximately 52° to the vertical.

5. The child resistant closure set forth in claim 1 wherein said means sealingly engaging said container and said means yieldingly urging the closure axially upwardly comprises a one-piece fitment in said closure.

6. A child resistant package comprising an open-mouth plastic container having a plurality of circumferentially spaced projections extending radially outwardly adjacent the open end thereof, each said projection having a shoulder facing downwardly in one circumferential direction, a plastic closure having a top panel and an annular skirt depending from the periphery of the top panel, a plurality of radially inwardly extending and circumferentially spaced locking lugs on the inner surface of said skirt, said locking lugs being adapted to engage the shoulders in the projections on the container, said closure having a fitment therein for sealingly engaging the open end of the container and extending downwardly into sealing engagement with the inner surface of the upper open end of the container, said fitment providing a spring to urge the locking lugs into engagement with said projections, said closure having a plurality of cam lugs positioned on the inner surface of said skirt such that they are positioned between projections when the closure is on the container and the lugs are in engagement with said projections, each said cam lug having an inclined surface operable to engage a projection when an axial force is applied to the closure and the closure is rotated in a direction to disengage the locking lugs from the shoulders to engage a projection so that continued rotation of the closure will cam the closure axially upwardly disengaging the closure from the container.

7. The child resistant package set forth in claim 6 wherein each said cam lug is generally triangular in vertical section.

8. The child resistant package set forth in claim 7 wherein said inclined surface of each said lug is at an angle of approximately 52° with the vertical.

* * * * *